US010134328B2

(12) United States Patent
Nam et al.

(10) Patent No.: US 10,134,328 B2
(45) Date of Patent: Nov. 20, 2018

(54) DISPLAY DEVICE AND DRIVING METHOD THEREOF

(71) Applicant: SAMSUNG DISPLAY CO., LTD., Yongin-si, Gyeonggi-do (KR)

(72) Inventors: Hui Nam, Yongin-si (KR); Myung Ho Lee, Yongin-si (KR); Dong Hoon Lee, Yongin-si (KR); Sung Yeon Cho, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 0 days.

(21) Appl. No.: 15/164,929

(22) Filed: May 26, 2016

(65) Prior Publication Data

US 2017/0084225 A1 Mar. 23, 2017

(30) Foreign Application Priority Data

Sep. 18, 2015 (KR) ..... 10-2015-0132388

(51) Int. Cl.
*G09G 3/32* (2016.01)
*G09G 3/36* (2006.01)
*G09G 3/3225* (2016.01)

(52) U.S. Cl.
CPC ..... *G09G 3/3225* (2013.01); *G09G 3/3648* (2013.01); *G09G 2300/0439* (2013.01); *G09G 2310/08* (2013.01); *G09G 2360/12* (2013.01)

(58) Field of Classification Search
CPC ..... G09G 3/3225; G09G 3/3648; G09G 2300/0439; G09G 2310/08; G09G 2360/12
USPC ..... 345/213
See application file for complete search history.

(56) References Cited

U.S. PATENT DOCUMENTS

2004/0189568 A1* 9/2004 Lee ..... G09G 3/2011 345/89
2006/0077191 A1* 4/2006 Ming-Daw ..... G02F 1/133351 345/204
2007/0046607 A1* 3/2007 Lai ..... G09G 3/3648 345/92
2009/0027325 A1* 1/2009 Kim ..... G02F 1/136286 345/92
2010/0156945 A1* 6/2010 Yoshida ..... G02F 1/1345 345/690

FOREIGN PATENT DOCUMENTS

KR 10-2014-0134513 A 11/2014

* cited by examiner

*Primary Examiner* — Stephen G Sherman
(74) *Attorney, Agent, or Firm* — Lee & Morse, P.C.

(57) ABSTRACT

A display device includes a display panel, a scan driver, and a data driver. The display panel includes a plurality of pixels connected to the scan lines and data lines. The scan driver supplies a scan signal via the scan lines. The data driver supplies data signals via the data lines. At least one scan line of the scan lines is connected to pixels in a plurality of lines, and the pixels connected to the at least one scan line is connected to different data lines. The display panel may be a non-rectangular display panel.

14 Claims, 5 Drawing Sheets

| | D1 | D2 | D3 | D4 | D5 | D6 |
|---|---|---|---|---|---|---|
| data(a,d) | a-3 | d-2 | d-3 | d-4 | d-5 | a-4 |
| data(b,e) | b-2 | b-3 | e-3 | e-4 | b-4 | b-5 |
| data(c) | c-1 | c-2 | c-3 | c-4 | c-5 | c-6 |

| | D1 | D2 | D3 | D4 | D5 | D6 | D7 | D8 |
|---|---|---|---|---|---|---|---|---|
| data(a,e) | a-4 | e-2 | e-3 | e-4 | e-5 | e-6 | e-7 | a-5 |
| data(b,f) | b-4 | b-3 | f-3 | f-4 | f-5 | f-6 | b-6 | b-5 |
| data(c,g) | c-4 | c-2 | c-3 | g-4 | g-5 | c-6 | c-7 | c-5 |
| data(d) | d-1 | d-2 | d-3 | d-4 | d-5 | d-6 | d-7 | d-8 |

DISPLAY DEVICE AND DRIVING METHOD THEREOF

CROSS-REFERENCE TO RELATED APPLICATION

Korean Patent Application No. 10-2015-0132388, filed on Sep. 18, 2015, and entitled, "Display Device and Driving Method Thereof," is incorporated by reference herein in its entirety.

BACKGROUND

1. Field

One or more embodiments described herein relate to a display device and a method for driving a display device.

2. Description of the Related Art

Various kinds of mobile devices have displays. The displays may include pixels connected to scan lines and data lines, a scan driver for supplying scan signals via the scan lines, and a data driver for supplying data signals via the data lines. Examples of displays of this type include liquid crystal displays and organic light emitting displays.

Some mobile devices have been developed to have non-rectangular displays. For example, smart watches have been developed to have circular displays.

In current non-rectangular displays, the number of pixels differ depending on the lines and rows in the display panel. When the wire structure of the scan lines and data lines is applied to a non-rectangular display panel, the number of scan lines and data lines depends on the maximum number of pixels in the lines and rows of the display panel.

Therefore, it is inefficient to apply the wire structure and driving method of a rectangular display panel to a non-rectangular display panel. Also, unnecessary power consumption may occur.

SUMMARY

In accordance with one or more embodiments, a display device includes a display panel including a plurality of pixels connected to scan lines and data lines, a scan driver to supply a scan signal via the scan lines, and a data driver to supply data signals via the data lines, wherein at least one scan line of the scan lines is connected to pixels in a plurality of lines and wherein the pixels connected to the at least one scan line is connected to different data lines.

The at least one scan line may include a first sub scan line connected to the pixels of one line and a second sub scan line connected to the pixels of one or more different lines. At least one other scan line may be connected to pixels in one line. The line of the pixels connected to the at least one other scan line may include a largest number of pixels in the display panel. Each of the scan lines may be connected to a same number of pixels.

Some of the data lines may include a first sub data line extending in a first direction, and a second sub data line extending in a second direction different from the first direction. Additional ones of the data lines may extend in the first direction. The data lines may be connected to a same number of pixels. The second sub data line may be connected to the pixels of different rows. The second sub data line may have a curvature corresponding to a shape of the display panel.

Some of the data lines may include third sub data lines connected to the pixels of one row and fourth sub data lines connected to the pixels of different rows. Additional ones of the data lines may be connected to pixels in one row.

The display device may include a data processor to determine an arrangement and output sequence of data signals corresponding to each of the pixels, wherein the data signals are to be supplied simultaneously to the pixels connected to a same scan line. The data processor may include a frame memory to store data of one frame. The display panel may be a non-rectangular display panel. The display panel may be a circular-shaped display panel.

In accordance with one or more other embodiments, a method for driving a display device includes supplying a same scan signal to pixels in a plurality of lines; and simultaneously supplying data signals to the pixels receiving the same scan signal. The method may include determining an arrangement and output sequence of the data corresponding to each pixel, wherein the data signals may be supplied simultaneously to the pixels receiving the same scan signal.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
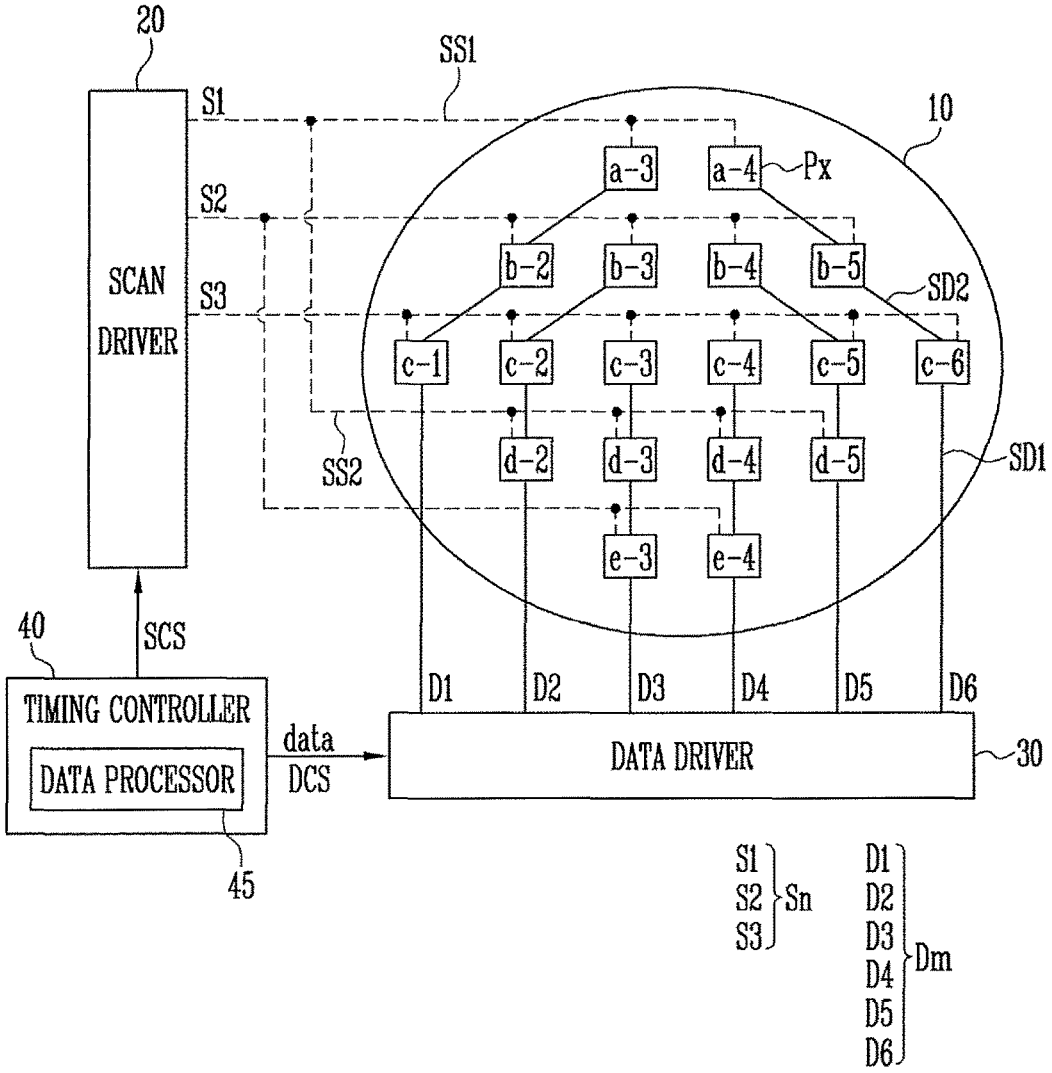
FIG. 1 illustrates an embodiment of a display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout. Furthermore, 'connected/accessed' represents that one component is directly connected or accessed to another component or indirectly connected or accessed through another component.

FIG. 1 illustrates an embodiment of a display device which includes a display panel 10, scan driver 20, data driver 30 and timing controller 40. The display panel 10 includes a plurality of pixels Px connected to scan lines Sn and data lines Dm. The pixels Px receive scan signals via the scan lines Sn and receive data signals via the data lines Dm. A pixel Px is selected when a scan signal is supplied. The pixel PX then receives a data signal and emits light at a brightness corresponding to the data signal.

The display panel 10 may be, for example, a liquid crystal display panel or organic light emitting display panel. Furthermore, the display panel 10 may be a non-rectangular display panel. In this embodiment, the display panel 10 is a circular-shaped display panel. Therefore, the pixels (Px) are arranged in a circular shape overall. Hereinafter, for ease of understanding, explanation will be made of pixels (Px) arranged in five lines from line a to line e, and six rows from row 1 to row 6. The display panel 10 may include a different number of lines and/or rows in another embodiment. Also, the display panel 10 may have a non-rectangular shape different from a circular shape in another embodiment.

At least one of the scan lines Sn is connected to pixels arranged in a plurality of lines. The number of pixels that each scan line Sn is connected to may be the same or different. For example, some of the scan lines Sn may include a first sub scan line SS1 connected to the pixels of one line and a second sub scan line SS2 connected to the pixels of other lines. Other scan lines Sn may be connected to the pixels of the line having, for example, the greatest number of pixels.

In one embodiment, the first scan line S1 is connected to pixels of line a (a-3, a-4) and pixels of line d (d-2, d-3, d-4, d-5). The second scan line S2 is connected to pixels of line b (b-2, b-3, b-4, b-5) and pixels of line e (e-3, e-4). The third scan line S3 is connected to pixels of line c (c-1, c-2, c-3, c-4, c-5, c-6). For example, the first scan line S1 and second scan line S2 are connected to pixels of two lines, while the third scan line S3 is connected to pixels of one line. Thus, the number of pixels connected to each scan line Sn is the same, namely six.

The pixels connected to the same scan line are connected to different data lines. The number of pixels connected to each data line Dm may be set to be the same. Some part of the data lines Dm may not be straight, but instead be diagonal or curved so that the data lines Dm may be connected to the pixels in different rows. For example, some of the data lines Dm may include a first sub data line SD1 extending in a vertical direction and a second sub data line SD2 extending in a diagonal direction. The first sub data line SD1 is connected to the pixels in a same row, while the second sub data line SD2 is connected to the pixels in different rows. Furthermore, the second sub data line SD2 may have a curvature that corresponds to the shape of the display panel 10. Furthermore, some of the other data lines may extend in a vertical direction overall.

For example, the first data line D1 is connected to the pixel of line a row 3 (a-3), the pixel of line b row 2 (b-2), and the pixel of line c row 1 (c-1). The second data line D2 is connected to the pixel of line b row 3 (b-3), the pixel of line c row 2 (c-2), and the pixel of line d row 2 (d-2). The third data line D3 is connected to the pixel of line c row 3 (c-3), the pixel of line d row 3 (d-3), and the pixel of line e row 3 (e-3). The fourth data line D4 is connected to the pixel of line c row 4 (c-4), the pixel of line d row 4 (d-4), and the pixel of line e row 4 (e-4). The fifth data line D5 is connected to the pixel of line b row 4 (b-4), the pixel of line c row 5 (c-5), and the pixel of line d row 5 (d-5). The sixth data line D6 is connected to the pixel of line a row 4 (a-4), the pixel of line b row 5 (b-5), and the pixel of line c row 6 (c-6).

Each of the first data line D1, second data line D2, fifth data line D5, and sixth data line D6 includes a first sub data line SD1 extending in a vertical direction and a second sub data line SD2 extending in a diagonal direction. On the other hand, all sections of the third data line D3 and fourth data line D4 extend in the vertical direction. The number of pixels connected to each data line (Dm) is the same, namely three.

The scan driver 20 is connected to the scan lines Sn, generates a scan signal in response to a scan control signal SCS, and outputs the generated scan signal to the scan lines (Sn). In an embodiment, the scan driver 20 may include of a plurality of stage circuits and may supply a scan signal sequentially to the scan lines Sn. When a scan signal is sequentially supplied to the scan lines Sn, the pixels Px in one or a plurality of lines are selected.

The data driver 30 is connected to the data lines Dm, generates data signals in response to a data control signal (DCS) of the timing controller 40, and outputs the generated data signals to the data lines Dm. The data driver 30 converts digital data from the timing controller 40 into analog data signals and outputs the analog data signals to the data lines Dm.

The timing controller 40 receives image data, sync signals, and clock signals for controlling display of the image data. The timing controller 40 modifies the received image data to be suitable for display on the display panel 10 and outputs the modified data to the data driver 30. Furthermore, the timing controller 40 may generate drive control signals (SCS, DCS) for controlling the driving of the scan driver 20 and data driver 30 based on the sync signals and clock signals.

The timing controller 40 may include a data processor 45 to determine the arrangement and sequence of data corresponding to each pixel Px. For example, the data processor 45 may arrange the data and adjust the output sequence such that data signals are supplied simultaneously to the pixels connected to a same scan line. For this purpose, the data processor 45 may include a frame memory to store data forming one frame. In this embodiment, the data processor 45 is integrated into the timing controller 40. In other embodiments, the data processor 45 and the timing controller 40 may be separate components.

Figures 2A, 2B:
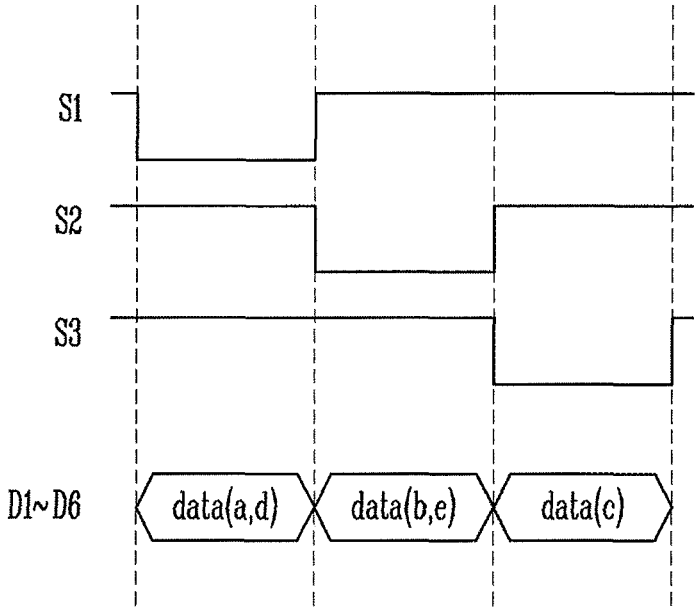
FIG. 2A is a waveform diagram illustrating an embodiment of a method for driving a display device.
FIG. 2B illustrates an example of a table for explaining data signals corresponding to pixels of the display device.

FIG. 2A is a waveform diagram illustrating an embodiment of a method for driving a display device, which, for example, may be the display device in FIG. 1. FIG. 2*b* is an example of a table for explaining data signals corresponding to pixels in the display device.

Referring to FIGS. 2A and 2B, the scan driver 20 supplies a scan signal of a gate on voltage to the first scan line S1 and the data driver 30 supplies data signals corresponding to data (a, d) to the data lines Dm. For example, the first scan line S1 is connected to the pixels of line a (a-3, a-4), and the pixels of line d (d-2, d-3, d-4, d-5). Each of the data lines Dm is connected to the pixels of line a (a-3, a-4) and the pixels of line d (d-2, d-3, d-4, d-5). Therefore, when a scan signal is supplied to the first scan line S1, the pixels of line a (a-3, a-4) and the pixels of line d (d-2, d-3, d-4, d-5) receive data signals corresponding to data (a, d) from the data lines Dm.

For example, a data signal corresponding to the pixel of line a row 3 (a-3) is supplied to the first data line D1, a data signal corresponding to the pixel of line d row 2 (d-2) is supplied to the second data line D2, a data signal corresponding to the pixel of line d row 3 (d-3) is supplied to the third data line D3, a data signal corresponding to the pixel of line d row 4 (d-4) is supplied to the fourth data line D4, a data signal corresponding to the pixel of line d row 5 (d-5) is supplied to the fifth data line D5, and a data signal corresponding to the pixel of line a row 4 (a-4) is supplied to the sixth data line D6.

Next, the scan driver 20 supplies a scan signal of a gate on voltage to the second scan line S2 and the data driver 30 supplies data signals corresponding to data (b, e) to the data lines Dm. For example, the second scan line S2 is connected to the pixels of line b (b-2, b-3, b-4, b-5) and the pixels of line e (e-3, e-4). Each of the data lines Dm is connected to the pixels of line b (b-2, b-3, b-4, b-5) and the pixels of line e (e-3, e-4). Therefore, when a scan signal is supplied to the second scan line S2, the pixels of line b (b-2, b-3, b-4, b-5) and the pixels of line e (e-3, e-4) receive data signals corresponding to data (b, e) from the data lines Dm.

For example, a data signal corresponding to the pixel of line b row 2 (b-2) is supplied to the first data line D1, a data signal corresponding to the pixel of line b row 3 (b-3) is supplied to the second data line D2, a data signal corresponding to the pixel of line e row 3 (e-3) is supplied to the third data line D3, a data signal corresponding to the pixel of line e row 4 (e-4) is supplied to the fourth data line D4, a data signal corresponding to the pixel of line b row 4 (b-4) is supplied to the fifth data line D5, and a data signal corresponding to the pixel of line b row 5 (b-5) is supplied to the sixth data line D6.

Next, the scan driver 20 supplies a scan signal of a gate on voltage to the third scan line S3 and the data driver 30 supplies a data signal corresponding to data (c) to the data lines Dm. For example, the third scan line S3 is connected to the pixels of line c (c-1, c-2, c-3, c-4, c-5, c-6). Each of the data lines Dm is connected to the pixels of line c (c-1, c-2, c-3, c-4, c-5, c-6). Therefore, when a scan signal is supplied to the third scan line (S3), the pixels of line c (c-1, c-2, c-3, c-4, c-5, c-6) receive data signals corresponding to data (c) from the data lines Dm.

For example, a data signal corresponding to the pixel of line c row 1 (c-1) is supplied to the first data line D1, a data signal corresponding to the pixel of line c row 2 (c-2) is supplied to the second data line D2 a data signal corresponding to the pixel of line c row 3 (c-3) is supplied to the third data line D3, a data signal corresponding to the pixel of line c row 4 (c-4) is supplied to the fourth data line D4, a data signal corresponding to the pixel of line c row 5 (c-5) is supplied to the fifth data line D5, and a data signal corresponding to the pixel of line c row 6 (c-6) is supplied to the sixth data line D6.

Figure 3:
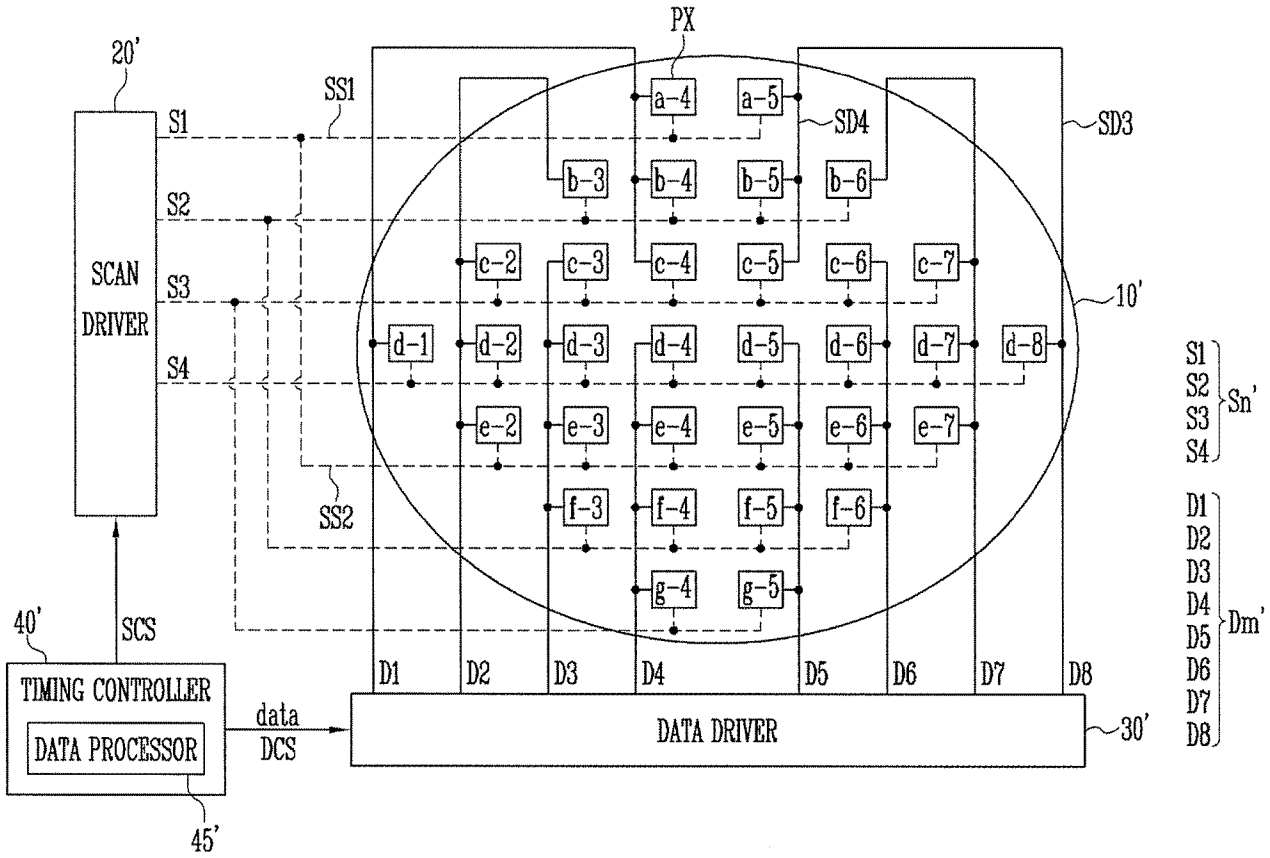
FIG. 3 illustrates another embodiment of a display device.

FIG. 3 illustrates another embodiment of a display device which includes, for example, pixels Px arranged in seven lines from line a to line g, eight rows from row 1 to row 8, and scan lines Sn' and data lines Dm' connected to the pixels Px. The display device may have a different number of pixels, rows, and/or lines in another embodiment.

Referring to FIG. 3, at least one of the scan lines Sn' is connected to the pixels arranged in a plurality of lines. The number of pixels that each scan line Sn' is connected to may be the same or different. Some of the scan lines Sn' may include a first sub scan line SS1 connected to the pixels of one line and a second sub scan line SS2 connected to pixels of other lines. Other scan lines Sn' may be connected to the pixels of the line having the greatest number of pixels.

In one embodiment, the first scan line S1 is connected to the pixels of line a (a-4, a-5) and the pixels of line e (e-2, e-3, e-4, e-5, e-6, e-7). The second scan line S2 is connected to the pixels of line b (b-3, b-4, b-5, b-6) and the pixels of line f (f-3, f-4, f-5, f-6). The third scan line S3 is connected to the pixels of line c (c-2, c-3, c-4, c-5, c-6, c-7) and the pixels of line g (g-4, g-5). The fourth scan line S4 is connected to the pixels of line d (d-1, d-2, d-3, d-4, d-5, d-6, d-7. d-8). Thus, the first scan line S1, second scan line S2, and third scan line S3 are connected to the pixels of two lines, while the fourth scan line S4 is connected to the pixels of one line. The number of pixels connected to each scan line Sn' is therefore the same, namely eight.

The pixels connected to the same scan line are connected to different data lines. The number of pixels connected to each data line Dm' may be set to be the same or different. Part of the data lines Dm' may include a third sub data line SD3 connected to the pixels of one row and a fourth sub data line SD4 connected to the pixels of different rows. Other parts of the data lines Dm' may be connected to the pixels in one row.

In one embodiment, the first data line D1 is connected to the pixel of line d row 1 (d-1), the pixel of line a row 4 (a-4), the pixel of line b row 4 (b-4) and the pixel of line c row 4 (c-4). The second data line D2 is connected to the pixel of line b row 3 (b-3), the pixel of line c row 2 (c-2), the pixel of line d row 2 (d-2), and the pixel of line e row 2 (e-2). The third data line D3 is connected to the pixel of line c row 3 (c-3), the pixel of line d row 3 (d-3), the pixel of line e row 3 (e-3), and the pixel of line f row 3 (f-3). The fourth data line D4 is connected to the pixel of line d row 4 (d-4), the pixel of line e row 4 (e-4), the pixel of line f row 4 (f-4), and the pixel of line g row 4 (g-4). The fifth data line D5 is connected to the pixel of line d row 5 (d-5), the pixel of line e row 5 (e-5), the pixel of line f row 5 (f-5), and the pixel of line g row 5 (g-5). The sixth data line D6 is connected to the pixel of line c row 6 (c-6), the pixel of line d row 6 (d-6), the pixel of line e row 6 (e-6), and the pixel of line f row 6 (f-6). The seventh data line D7 is connected to the pixel of line b row 6 (b-6), the pixel of line c row 7 (c-7), the pixel of line d row 7 (d-7), and the pixel of line e row 7 (e-7). The eighth data line D8 is connected to the pixel of line a row 5 (a-5), the pixel of line b row 5 (b-5), the pixel of line c row 5 (c-5), and the pixel of line d row 8 (d-8).

Figures 4A, 4B:
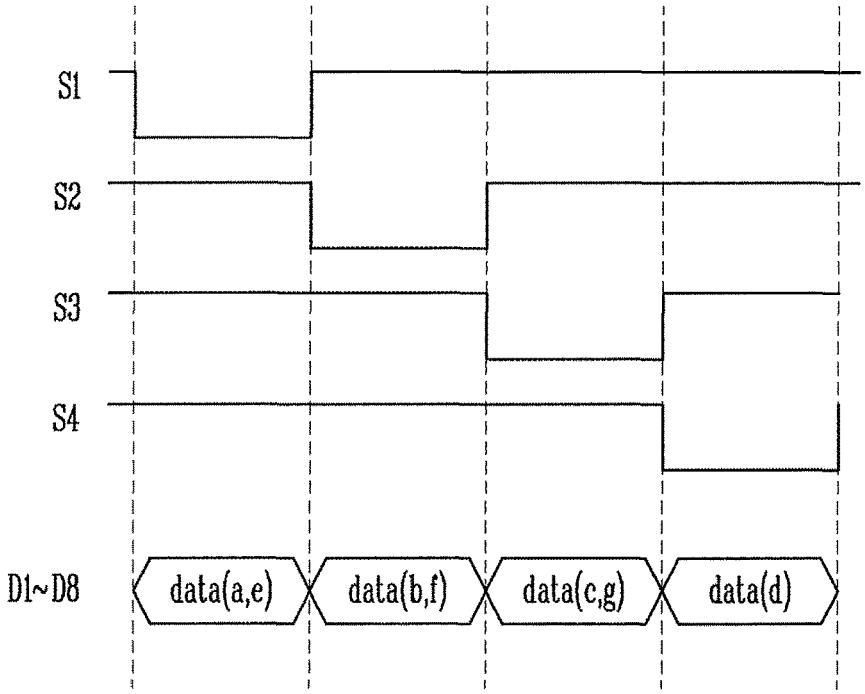
FIG. 4A is a waveform diagram illustrating another embodiment of a method for driving a display device.
FIG. 4B illustrates another example of a table for explaining data signals corresponding to pixels of the display device.

FIG. 4A is a waveform illustrating an embodiment of a method for driving the display device in FIG. 3, and FIG. 4B is ab example of a table for explaining data signals corresponding to pixels in the display device.

Referring to FIGS. 4A and 4B, the scan driver 20' supplies a scan signal of gate on voltage to the first scan line S1 and the data driver 30' supplies data signals corresponding to data (a, e) to the data lines Dm'. For example, the first scan line S1 is connected to the pixels of line a (a-4, a-5), and the pixels of line e (e-2, e-3, e-4, e-5, e-6, e-7). Each of the data lines Dm' is connected to the pixels of line a (a-4, a-5) and the pixels of line e (e-2, e-3, e-4, e-5, e-6, e-7). Therefore, when a scan signal is supplied to the first scan line S1, the pixels of line a (a-4, a-5) and the pixels of line e (e-2, e-3, e-4, e-5, e-6, e-7) receive data signals corresponding to data (a, e) from the data lines Dm'.

For example, a data signal corresponding to the pixel of line a row 4 (a-4) is supplied to the first data line DE a data signal corresponding to the pixel of line e row 2 (e-2) is supplied to the second data line D2, a data signal corresponding to the pixel of line e row 3 (e-3) is supplied to the third data line D3, a data signal corresponding to the pixel of line e row 4 (e-4) is supplied to the fourth data line D4, a data signal corresponding to the pixel of line e row 5 (e-5) is supplied to the fifth data line D5, a data signal corresponding to the pixel of line e row 6 (e-6) is supplied to the sixth data line D6, a data signal corresponding to the pixel of line e row 7 (e-7) is supplied to the seventh data line D7, and a data signal corresponding to the pixel of line a row 5 (a-5) is supplied to the eighth data line D8.

Next, the scan driver 20' supplies a scan signal of a gate on voltage to the second scan line S2, and the data driver 30' supplies data signals corresponding to data (b, f) to the data lines Dm'. In one embodiment, the second scan line S2 is connected to the pixels of line b (b-3, b-4, b-5, b-6) and the pixels of line f (f-3, f-4, f-5, f-6). Each of the data lines Dm' is connected to the pixels of line b (b-3, b-4, b-5, b-6) and the pixels of line f (f-3, f-4, f-5, f-6). Therefore, when a scan signal is supplied to the second scan line S2, the pixels of line b (b-3, b-4, b-5, b-6) and the pixels of line f (f-3, f-4, f-5, f-6) receive data signals corresponding to data (b, f) from the data lines Dm'.

In accordance with one embodiment, a data signal corresponding to the pixel of line b row 4 (b-4) is supplied to the first data line D1, a data signal corresponding to the pixel of line b row 3 (b-3) is supplied to the second data line D2, a data signal corresponding to the pixel of line f row 3 (f-3) is supplied to the third data line D3, a data signal corresponding to the pixel of line f row 4 (f-4) is supplied to the fourth data line D4, a data signal corresponding to the pixel of line f row 5 (f-5) is supplied to the fifth data line D5, a data signal corresponding to the pixel of line f row 6 (f-6) is supplied to the sixth data line D6, a data signal corresponding to the pixel of line b row 7 (b-7) is supplied to the seventh data line D7, and a data signal corresponding to the pixel of line b row 5 (b-5) is supplied to the eighth data line D8.

Next, the scan driver 20' supplies a scan signal of a gate on voltage to the third scan line S3 and the data driver 30' supplies data signals corresponding to data (c,g) to the data lines Dm'. For example, the third scan line (S3) is connected to the pixels of line c (c-2, c-3, c-4, c-5, c-6, c-7) and the pixels of line g (g-4, g-5). Each of the data lines Dm' is connected to the pixels of line c (c-2, c-3, c-4, c-5, c-6, c-7) and the pixels of line g (g-4, g-5). Therefore, when a scan signal is supplied to the third scan line S3, the pixels of line c (c-2, c-3, c-4, c-5, c-6, c-7) and the pixels of line g (g-4, g-5) receive data signals corresponding to data (c,g) from the data lines Dm'.

For example, a data signal corresponding to the pixel of line c row 4 (c-4) is supplied to the first data line D1, a data signal corresponding to the pixel of line c row 2 (c-2) is supplied to the second data line D2, a data signal corresponding to the pixel of line c row 3 (c-3) is supplied to the third data line D3, a data signal corresponding to the pixel of line g row 4 (g-4) is supplied to the fourth data line D4, a data signal corresponding to the pixel of line g row 5 (g-5) is supplied to the fifth data line D5, a data signal corresponding to the pixel of line c row 6 (c-6) is supplied to the sixth data line D6, a data signal corresponding to the pixel of line c row 7 (c-7) is supplied to the seventh data line D7, and a data signal corresponding to the pixel of line c row 5 (c-5) is supplied to the eighth data line D8.

Next, the scan driver 20' supplies a scan signal of a gate on voltage to the fourth scan line S4 and the data driver 30' supplies data signals corresponding to data (d) to the data lines Dm'. For example, the fourth scan line S4 is connected to the pixels of line d (d-1, d-2, d-3, d-4, d-5, d-6, d-7. d-8). Each of the data lines Dm' is connected to the pixels of line d (d-1, d-2, d-3, d-4, d-5, d-6, d-7. d-8). Therefore, when a scan signal is supplied to the fourth scan line S4, the pixels of line d (d-1, d-2, d-3, d-4, d-5, d-6, d-7. d-8) receive data signals corresponding to data (d) from the data lines Dm'.

In one embodiment, a data signal corresponding to the pixel of line d row 1 (d-1) is supplied to the first data line D1, a data signal corresponding to the pixel of line d row 2 (d-2) is supplied to the second data line D2, a data signal corresponding to the pixel of line d row 3 (d-3) is supplied to the third data line D3, a data signal corresponding to the pixel of line d row 4 (d-4) is supplied to the fourth data line D4, a data signal corresponding to the pixel of line d row 5 (d-5) is supplied to the fifth data line D5, a data signal corresponding to the pixel of line d row 6 (d-6) is supplied to the sixth data line D6, a data signal corresponding to the pixel of line d row 7 (d-7) is supplied to the seventh data line D7, and a data signal corresponding to the pixel of line d row 8 (d-8) is supplied to the eighth data line D8.

Figure 5:
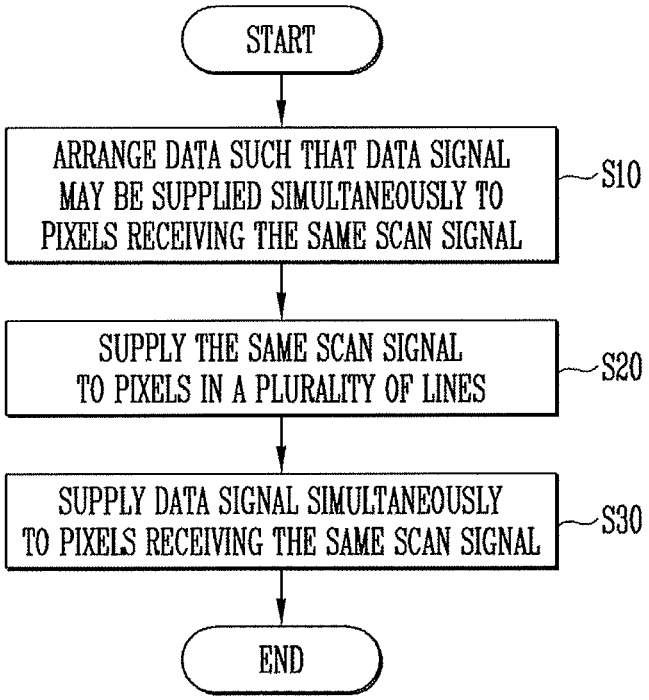
FIG. 5 illustrates another embodiment of a method for driving a display device.

FIG. 5 illustrates another embodiment of a method for driving a display device. Referring to FIG. 5, first, the data processor 45 arranges data and adjusts an output sequence such that data signals are supplied simultaneously to the pixels connected to a same scan line (S10). The data processor 45 may predetermine that the data forming one frame may be output to a suitable data line according to the wire structure of scan lines Sn and data lines Dm.

The scan driver 20 supplies scan signals to the scan lines (Sn). For example, the scan signals may be supplied to the pixels of one line or two lines according to the wire structure of the scan lines Sn. For example, when the scan signals are supplied to the first scan line S1 in FIG. 1, the pixels of line a (a-3, a-4) and the pixels of line d (d-2, d-3, d-4, d-5) are selected. When the scan signals are supplied to the second scan line S2, the pixels of line b (b-2, b-3, b-4, b-5) and the pixels of line e (e-3, e-4) are selected. When the scan signals are supplied to the third line S3, the pixels of line c (c-1, c-2, c-3, c-4, c-5, c-6) are selected.

The data driver 30 supplies the data signals to the pixels selected by the scan signals (S30). Then, the data signals are supplied to the pixels of one line or two lines selected by the scan signals. For example, when the scan signals are supplied to the first scan line S1, the pixels of line a (a-3, a-4) and the pixels of line d (d-2, d-3, d-4, d-5) in FIG. 1 receive the data signals from the data lines Dm. When the scan signals are supplied to the second scan line S2, the data signals are supplied to the pixels of line b (b-2, b-3, b-4, b-5) and the pixels of line 3 (e-3, e-4), and when the scan signals are supplied to the third scan line S3, the data signals are supplied to the pixels of line c (c-1, c-2, c-3, c-4, c-5, c-6). The pixels Px that received the data signals emit light of a predetermined brightness based on the data signals.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, drivers, and processors in the embodiments described herein may be implemented in logic which, for example, may include hardware, software, or both. When implemented at least partially in hardware, the controllers, drivers, and processors may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, drivers, and processors may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, mobile devices have been developed that include non-rectangular display panels. However, these displays are inefficient in terms of space and power consumption. In accordance with one or more of the aforementioned embodiments, at least one scan line is connected to pixels in a plurality of lines, and the pixels connected to the scan line are connected to different data lines. Thus, the number of scan lines may be reduced, thereby saving power consumption.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments set forth in the following claims.

What is claimed is:

1. A display device, comprising:

a non-rectangular display panel including a plurality of pixels connected to scan lines and data lines;

a scan driver to supply a scan signal via the scan lines; and a data driver to supply data signals via the data lines, wherein at least one scan line of the scan lines is connected to a first sub scan line and a second sub scan line, wherein first pixels of the plurality of pixels are connected to the first sub scan line and first data lines of the data lines, wherein second pixels of the plurality of pixels are connected to the second sub scan line and second data lines of the data lines, the first data lines are different from the second data lines, at least one other scan line of the scan lines is not connected to any sub scan lines, and third pixels of the plurality of pixels are connected to the at least one other scan line and one of the first data lines and the second data lines.

2. The display device as claimed in claim 1, wherein the pixels connected to the at least one other scan line includes a largest number of pixels in the non-rectangular display panel.

3. The display device as claimed in claim 1, wherein each of the scan lines is connected to a same number of pixels.

4. The display device as claimed in claim 1, wherein some of the data lines include:

a first sub data line extending in a first direction, and a second sub data line extending in a second direction different from the first direction.

5. The display device as claimed in claim 4, wherein additional ones of the data lines extend in the first direction.

6. The display device as claimed in claim 5, wherein the data lines are connected to a same number of pixels.

7. The display device as claimed in claim 4, wherein the second sub data line is connected to pixels of different rows.

8. The display device as claimed in claim 4, wherein the second sub data line has a curvature corresponding to a shape of the non-rectangular display panel.

9. The display device as claimed in claim 4, wherein some of the data lines include:

third sub data lines connected to pixels of one row, and fourth sub data lines connected to pixels of different rows.

10. The display device as claimed in claim 9, wherein additional ones of the data lines are connected to pixels in one row.

11. The display device as claimed in claim 1, further comprising:

a data processor to determine an arrangement and output sequence of data signals corresponding to each of the pixels, wherein the data signals are to be supplied simultaneously to pixels connected to a same scan line.

12. The display device as claimed in claim 11, wherein the data processor includes a frame memory to store data of one frame.

13. The display device as claimed in claim 1, wherein the non-rectangular display panel is a circular-shaped display panel.

14. The display device as claimed in claim 1, wherein a number of pixels connected to the at least one scan line is a same as a number of pixels connected to the at least one other scan line.

* * * * *